US009640915B2

(12) United States Patent
Phillips et al.

(10) Patent No.: US 9,640,915 B2
(45) Date of Patent: May 2, 2017

(54) ELECTRICAL CONNECTOR WITH A PROGRAMMABLE GROUND TIE BAR

(71) Applicant: Tyco Electronics Corporation, Berwyn, PA (US)

(72) Inventors: Michael John Phillips, Camp Hill, PA (US); Michael Eugene Shirk, Grantville, PA (US); Thomas de Boer, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 14/797,223

(22) Filed: Jul. 13, 2015

(65) Prior Publication Data

US 2017/0018880 A1 Jan. 19, 2017

(51) Int. Cl.
*H01R 13/6471* (2011.01)
*H01R 13/6585* (2011.01)

(52) U.S. Cl.
CPC ..... *H01R 13/6471* (2013.01); *H01R 13/6585* (2013.01)

(58) Field of Classification Search
CPC ..... H01R 13/6471; H01R 13/6581; H01R 13/6587
USPC ..... 439/103, 177, 189
See application file for complete search history.

(56) References Cited

U.S. PATENT DOCUMENTS 4,464,003 A 8/1984 Goodman et al.
6,004,160 A * 12/1999 Korsunsky ..... H01R 13/26 439/660
6,039,583 A * 3/2000 Korsunsky ..... H01R 23/6873 439/101
7,121,849 B2 10/2006 Vicich et al.
7,410,393 B1 8/2008 Rothermel et al.
7,604,490 B2 * 10/2009 Chen ..... H01R 13/6471 439/541.5
8,702,451 B2 * 4/2014 Luo ..... H01R 12/725 439/607.28
8,764,488 B2 * 7/2014 Zeng ..... H01R 13/6585 439/108
8,858,243 B2 * 10/2014 Luo ..... H01R 13/652 439/108
8,944,849 B1 * 2/2015 Yang ..... H01R 13/6588 439/607.07
9,276,342 B2 * 3/2016 Masubuchi ..... H01R 12/775
(Continued)

*Primary Examiner* — Amy Cohen Johnson
*Assistant Examiner* — Oscar C Jimenez

(57) ABSTRACT

An electrical connector includes an array of conductors held within a housing and a ground tie bar extending across the conductors. The conductors include signal conductors and configurable conductors, the latter being selectively configurable between a ground state and a signal state to define a ground conductor and a signal conductor, respectively. The ground tie bar includes a stem and plural ground fingers extending therefrom. The ground fingers align with associated configurable conductors to engage and electrically connect to the configurable conductors. The ground tie bar is programmable to selectively remove at least one ground finger from the ground tie bar. A respective configurable conductor is in the ground state when engaged by the associated ground finger, and is in the signal state when the associated ground finger is removed from the ground tie bar to increase a number of the signal conductors in the array of conductors.

19 Claims, 3 Drawing Sheets

(56) References Cited

U.S. PATENT DOCUMENTS

| | | | | |
|---|---|---|---|---|
| 9,337,585 | B1 * | 5/2016 | Yang | H01R 13/6583 |
| 2012/0315796 | A1 * | 12/2012 | Pang | H01R 13/6471<br>439/626 |
| 2014/0004744 | A1 * | 1/2014 | Hsu | H01R 13/658<br>439/626 |

* cited by examiner

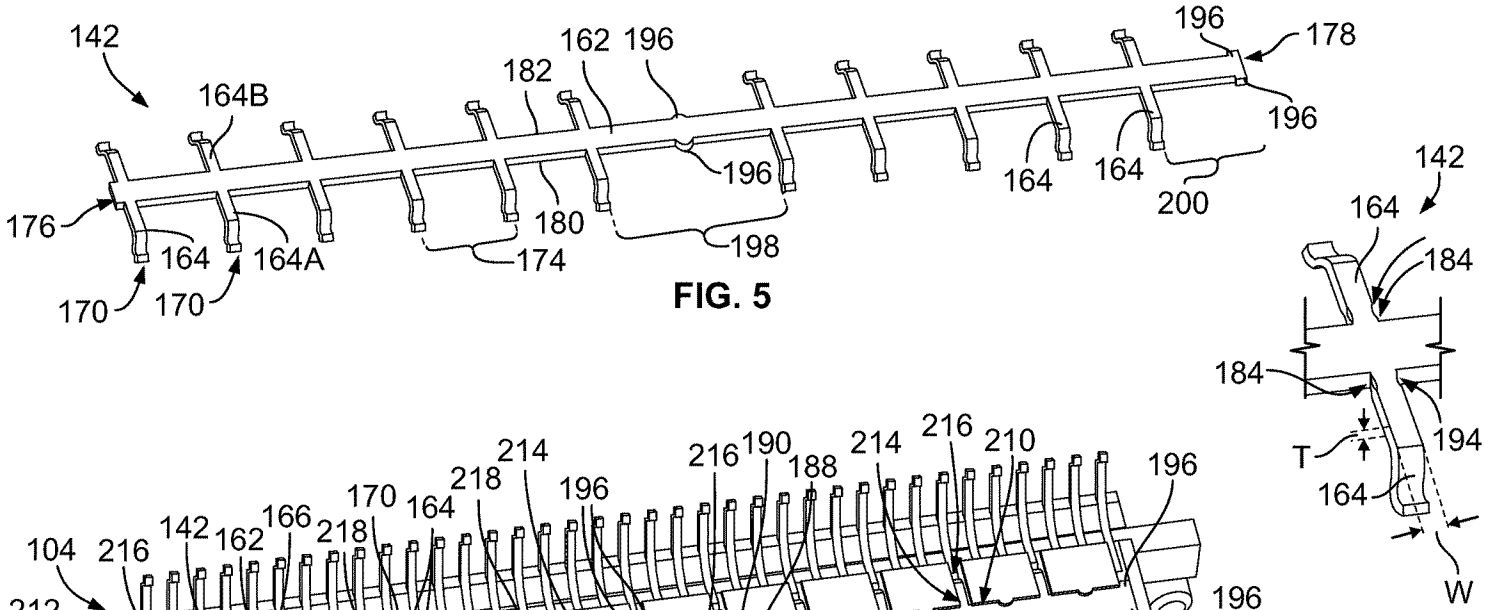
FIG. 5
FIG. 4
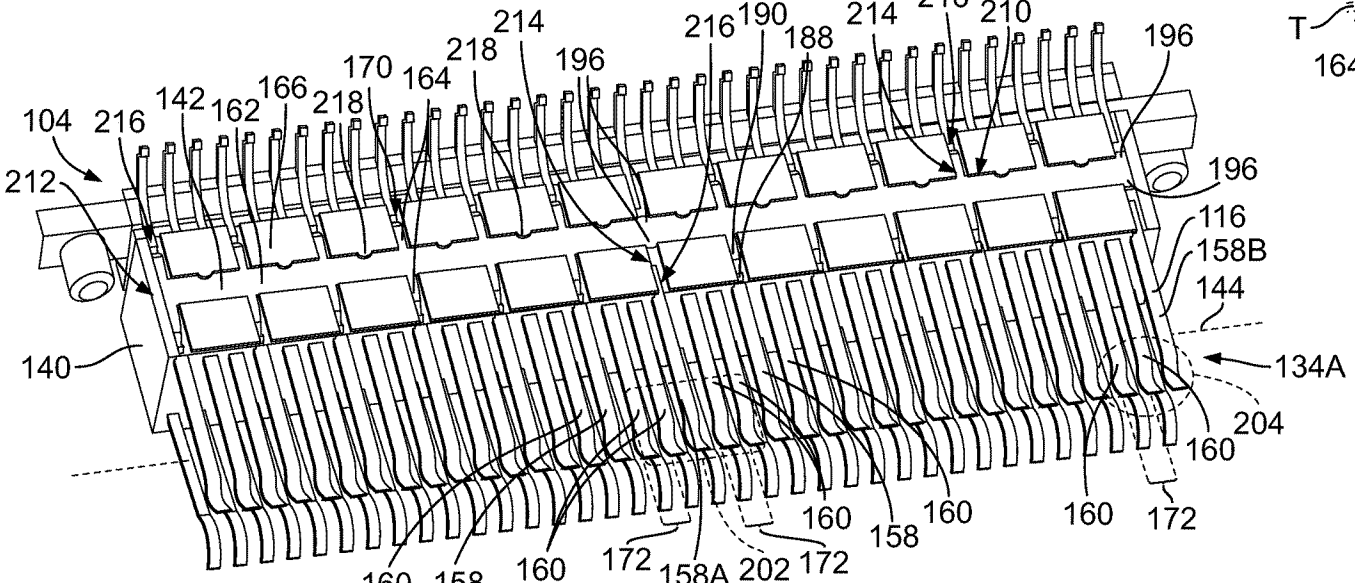
FIG. 6

ELECTRICAL CONNECTOR WITH A PROGRAMMABLE GROUND TIE BAR

BACKGROUND OF THE INVENTION

The subject matter herein relates generally to electrical connectors that have ground tie bars that electrically common ground conductors.

High speed electrical connectors typically transmit and receive high speed data signals over pairs of conductors, referred to as differential pairs. Adjacent differential pairs of signal conductors are separated by ground conductors to reduce electrical interference, such as cross-talk, between the adjacent pairs. But, while the ground conductors do isolate the signal pairs, the lengths of the ground conductors along the electrical connector between a mating end and a terminating end lead to resonances or resonance noise. The resonance noise is caused by standing electromagnetic waves that propagate along the ground conductors, varying the electrical potential of the ground conductors along the lengths. The resonance noise can interfere with the pairs of signal conductors to degrade the signal transmission performance. Both the resonance noise and cross-talk increase as the electrical connectors convey more data at faster data transfer rates and higher frequencies. Some high speed electrical connectors include ground tie bars that electrically connect the ground conductors to common the ground conductors together. The commoning of the ground conductors serves to reduce the resonance noise within the connector.

Electrical connectors with typical ground tie bars are not without disadvantages. For example, the ground conductors that are electrically commoned via the ground tie bar can only be used as ground conductors. But, some electrical connector systems convey signals other than high speed differential signals, such as power, low speed data signals, and the like, which may be conveyed using a single-ended conductor instead of a pair of two conductors. Single-ended conductors do not require shielding by ground conductors. In known electrical connectors, the ground conductors that are tied together are not reconfigurable as signal conductors because ground conductors that are electrically commoned cannot convey distinct signals. An exemplary high speed electrical connector known in the art may include a single ground conductor disposed between pairs of signal conductors along a length of a conductor array. In order to provide three single-ended conductors in a row, such as to provide power, receive low speed sensing data, and transmit low speed output data, two adjacent pairs of signal conductors are required to provide the three single-ended signal conductors. The ground conductor disposed between the two pairs of signal conductors is unused since single-ended conductors do not require shielding by ground conductors. The fourth signal conductor in the two pairs of signal conductors is also unused since only three single-ended conductors are required. Thus, in this example, two conductors are merely taking up valuable space in the electrical connector, which may be costly in light of the ongoing trend towards smaller, faster, and higher performance electrical connector systems.

A need remains for an electrical connector that can configure at least some electrical conductors as ground conductors that are electrically commoned together or as signal conductors for transmitting data in order to increase contact density and operability of the electrical connector.

BRIEF DESCRIPTION OF THE INVENTION

In an embodiment, an electrical connector configured to mate to a mating connector includes an array of conductors held at least partially within a housing and a ground tie bar extending across the array of conductors. The conductors in the array are arranged side-by-side along a row. The array of conductors includes signal conductors and configurable conductors. The configurable conductors are each selectively configurable between a ground state and a signal state to define a ground conductor or a signal conductor, respectively. The ground tie bar includes a stem and plural ground fingers joined to and extending from the stem. The ground fingers, when present, align with associated configurable conductors to engage and electrically connect to the configurable conductors. The ground tie bar is programmable to selectively remove one or more of the ground fingers from the ground tie bar to decrease a number of ground fingers of the ground tie bar. A respective configurable conductor is in the ground state when engaged by the associated ground finger. A respective configurable conductor is in the signal state when the associated ground finger is removed from the ground tie bar, and thus not present, to increase a number of the signal conductors in the array of conductors to correspond with a desired signal-ground electrical scheme.

In another embodiment, an electrical connector configured to mate to a mating connector includes an array of conductors held at least partially within a housing and a ground tie bar extending across the array of conductors. The conductors in the array are arranged side-by-side along a row. The array of conductors includes signal conductors and configurable conductors. The configurable conductors are each selectively configurable between a ground state and a signal state to define a ground conductor or a signal conductor, respectively. The ground tie bar extends across the array of conductors. The ground tie bar includes a stem and plural ground fingers joined to and extending from the stem. The ground fingers align with associated configurable conductors to engage and electrically connect to the configurable conductors. The ground tie bar is programmable from an intact formation to a fractured formation by selectively removing one or more of the ground fingers from the ground tie bar to decrease a number of ground fingers of the ground tie bar, such that the one or more ground fingers are not present. In the intact formation of the ground tie bar, all of the configurable conductors are engaged by the associated ground fingers and are in the ground state due to the engagement with the ground fingers of the ground tie bar. In the fractured formation of the ground tie bar, a respective configurable conductor that is associated with a ground finger removed from the ground tie bar is in the signal state, increasing a number of the signal conductors in the array of conductors to correspond with a desired signal-ground electrical scheme.

BRIEF DESCRIPTION OF THE DRAWINGS

FIG. 4 is a close-up perspective view of a portion of the ground tie bar according to an embodiment.

FIG. 5 is a perspective view of the ground tie bar programmed in a fractured formation according to an embodiment.

FIG. 6 is a front perspective view of the electrical connector configured with a different signal-ground electrical scheme than the configuration of the electrical connector in FIG. 2 according to an embodiment.

DETAILED DESCRIPTION OF THE INVENTION

Figure 1:
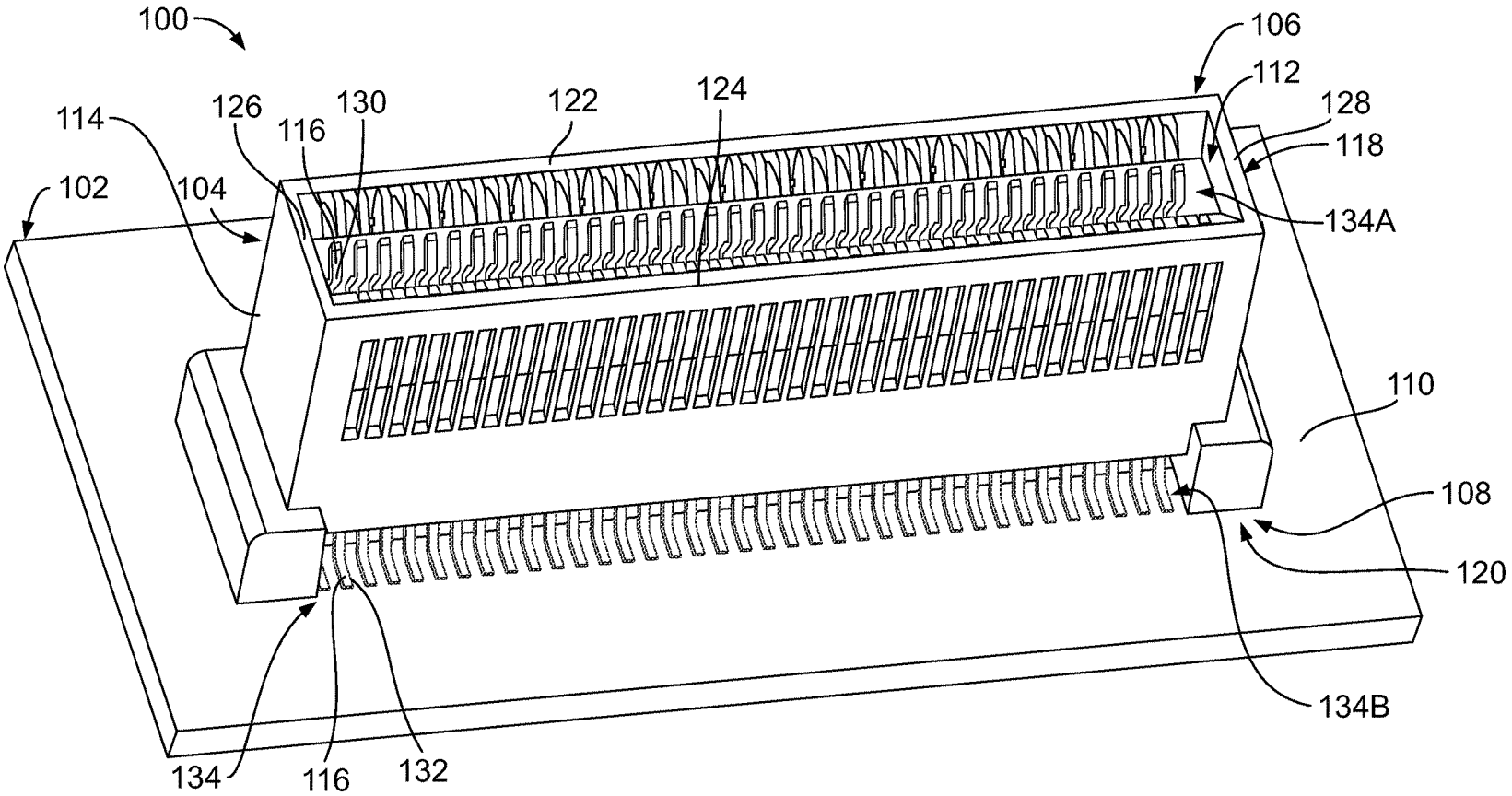
FIG. 1 is a perspective view of an electrical connector according to an embodiment.

FIG. 1 is a top perspective view of an electrical connector system 100 according to an embodiment. The electrical connector system 100 includes a circuit board 102 and an electrical connector 104 mounted to the circuit board 102. The electrical connector 104 is configured to electrically connect to a mating connector (not shown) in order to provide an electrically conductive signal path between the circuit board 102 and the mating connector. The electrical connector 104 may be a high speed connector that transmits data signals at speeds over 10 gigabits per second (Gbps), such as over 25 Gbps. The electrical connector 104 may also be configured to transmit low speed data signals and/or power. The electrical connector optionally may be an input-output (I/O) connector.

The electrical connector 104 extends between a mating end 106 and a mounting end 108. The mounting end 108 is terminated to a top surface 110 of the circuit board 102. The mating end 106 defines an interface for connecting to the mating connector. In the illustrated embodiment, the mating end 106 defines a socket 112 that is configured to receive a circuit card of the mating connector therein. The electrical connector 104 in the illustrated embodiment is a vertical board-mount connector such that the socket 112 is configured to receive the mating connector for mating in a loading direction that is transverse to, such as perpendicular to, the top surface 110 of the circuit board 102. In an alternative environment, the connector 104 may be a right angle style connector that is configured to receive the mating connector in a loading direction that is parallel to the top surface 110. In another alternative embodiment, the electrical connector 104 may be terminated to an electrical cable instead of to the circuit board 102. Although not shown, the mating connector may be a transceiver style connector that is configured to be terminated to one or more cables, a circuit card, or the like.

The electrical connector 104 includes a housing 114 and conductors 116 held at least partially within the housing 114. The housing 114 extends between a front end 118 and an opposite rear end 120. The front end 118 defines the mating end 106 of the connector 104 such that the socket 112 extends into the connector 104 via the front end 118. The socket 112 is defined by a first side wall 122, a second side wall 124, and first and second end walls 126, 128 that each extend between the side walls 122, 124. The side walls 122, 124 and end walls 126, 128 extend from the front end 118 of the housing 114 towards the rear end 120. The rear end 120 may define at least a portion of the mounting end 108 of the connector 104. For example, the rear end 120 abuts or at least faces the top surface 110 of the circuit board 102. Optionally, an organizer 138 (shown in FIG. 2) or another component may be disposed between the rear end 120 of the housing 114 and the circuit board 102. As used herein, relative or spatial terms such as "front," "rear," "first," "second," "left," and "right" are only used to distinguish the referenced elements and do not necessarily require particular positions or orientations in the connector system 100 or the electrical connector 104 relative to gravity or relative to the surrounding environment. In the illustrated orientation of the electrical connector 104, the first side wall 122 defines a top end of the socket 112, the second side wall 124 defines a bottom end of the socket 112, the first end wall 126 defines a left end of the socket 112, and the second end wall 128 defines a right end of the socket 112.

The conductors 116 of the electrical connector 104 are configured to provide conductive signal paths through the electrical connector 104. For example, each conductor 116 defines a mating contact beam 130 configured to engage and electrically connect to a corresponding mating contact of the mating connector within the socket 112 when the mating connector is fully mated to the electrical connector 104. The contact beam 130 engages the mating contact at a separable mating interface. The mating contact beams 130 are disposed within the socket 112. The conductors 116 further include terminating ends 132 configured to be terminated to corresponding contact elements (not shown) of the circuit board 102 via thru-hole mounting to conductive vias, surface-mounting to conductive pads, and/or the like. In the illustrated embodiment, the terminating ends 132 of the conductors 116 are surface-mounted to pads on the top surface 110 of the circuit board 102.

In an embodiment, the conductors 116 are organized in at least one array 134. The conductors 116 in a respective array 134 are arranged side-by-side in a row. In the illustrated embodiment, the conductors 116 are organized in two arrays 134. The only portion of the conductors 116 in a first array 134A of the two arrays 134 that is visible is the mating contact beam 130, while the only portion of the conductors 116 in a second array 134B of the two arrays 134 that is visible is the terminating end 132. The mating contact beams 130 of the conductors 116 in the first array 134A extend at least partially into the socket 112 from the first side wall 122, and the mating contact beams (not shown) of the conductors 116 of the second array 134B extend at least partially into the socket 112 from the second side wall 124. Thus, the mating contact beams 130 of the first array 134A of conductors 116 are configured to engage one side of a mating circuit card of the mating connector, while the mating contact beams 130 of the second array 134B of conductors 116 are configured to engage the opposite side of the mating circuit card. The contact beams 130 may be configured to deflect towards the respective side walls 122, 124 from which the contact beams 130 extend in order to exert a biased retention force on the mating circuit card to retain mechanical and electrical contact with the corresponding mating contacts. The first and second arrays 134A, 134B of the conductors 116 are shown in more detail in FIG. 2.

Figure 2:
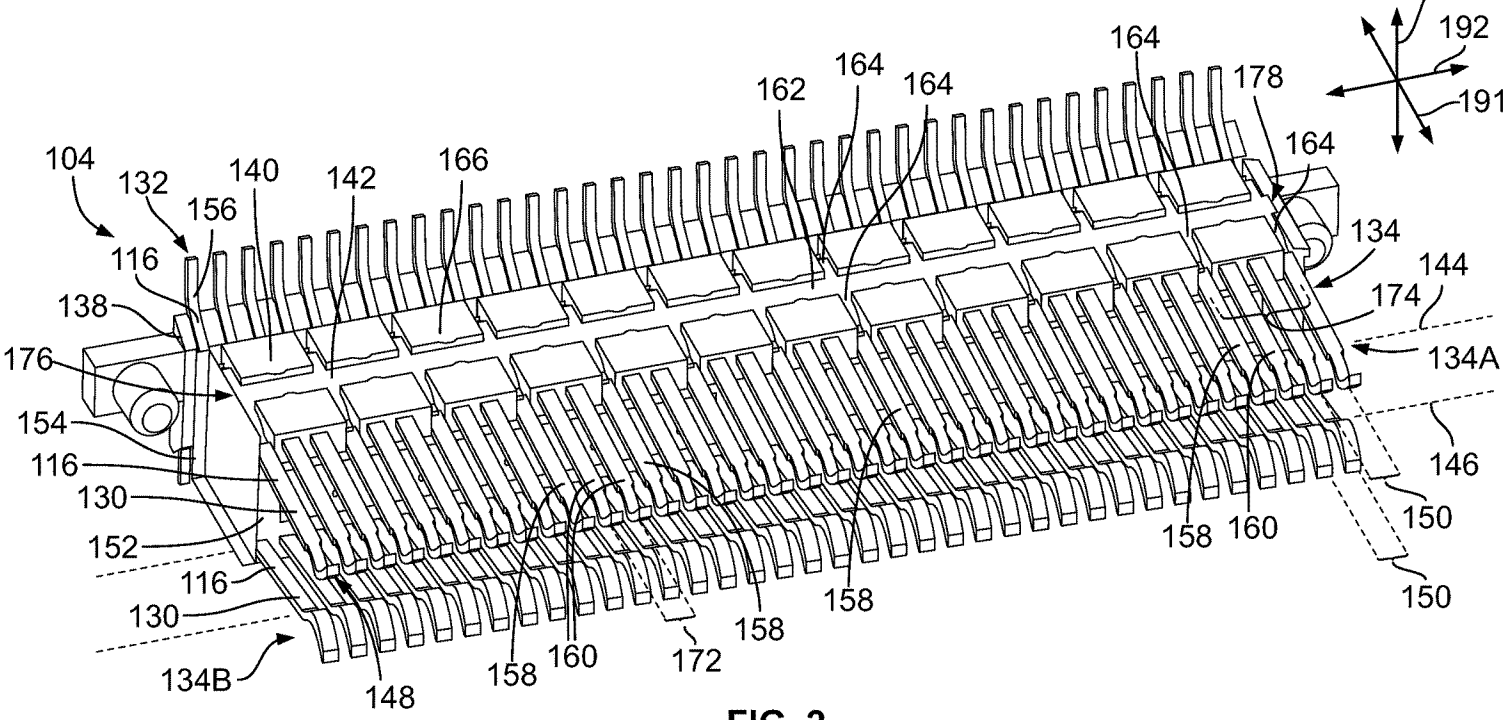
FIG. 2 is a front perspective view of the electrical connector according to an embodiment, shown with a housing of the connector removed.

FIG. 2 is a front perspective view of the electrical connector 104 with the housing 114 (shown in FIG. 1) removed according to an embodiment. The housing 114 is not shown in order to better illustrate the conductors 116 and other components of the electrical connector 104 within the housing 114. The electrical connector 104 in the illustrated embodiment includes the conductors 116, a dielectric carrier 140, and a ground tie bar 142. The conductors 116 are distributed in the first array 134A and the second array 134B. The mating contact beams 130 of the conductors 116 in the first array 134A are arranged side-by-side in a first row 144, and the mating contact beams 130 of the conductors 116 in the second array 134B are arranged side-by-side in a second row 146. The first and second rows 144, 146 extend parallel to each other and parallel to a lateral axis 192 of the electrical connector 104. The connector 104 is oriented with respect to a longitudinal or mating axis 191, the lateral axis 192, and a vertical or elevation axis 193. The axes 191-193 are mutually perpendicular. Although the elevation axis 193 appears to extend in a vertical direction parallel to gravity, it is understood that the axes 191-193 are not required to have any particular orientation with respect to gravity. In an alternative embodiment, the electrical connector 104 may include only one array 134 of conductors 116.

Each conductor 116 extends continuously between the terminating end 132 and a distal end 148 of the mating contact beam 130. Each conductor 116 may extend generally along the longitudinal axis 191 of the electrical connector 104. Adjacent conductors 116 in the same array 134 may extend parallel to one another. The conductors 116 are composed of an electrically conductive material, such as one or more metals. The one or more metals may include copper and/or silver, along or within an alloy. The conductors 116 may be stamped and formed into shape from a flat panel of metal.

The conductors 116 in each array 134 are evenly spaced apart along the lateral width of the connector 104 (for example, along the lateral axis 192). For example, adjacent conductors 116 in the same array 134 are separated from one another by a conductor pitch distance 150. As used herein, a pitch distance is the distance between lateral mid-points of the adjacent components, such as adjacent conductors 116 in this context, and not the distance between edges of the adjacent components. In an embodiment, the conductors 116 are held in place by the dielectric carrier 140. The dielectric carrier 140 extends between a front wall 152 and a rear wall 154. The conductors 116 extend through the dielectric carrier 140 such that the mating contact beams 130 protrude from the front wall 152 and terminating segments 156 of the conductors 116 that include the terminating ends 132 protrude from the rear wall 154. In the illustrated embodiment, the conductors 116 in the first and second arrays 134A, 134B extend through the dielectric carrier 140. Thus, the dielectric carrier 140 engages an intermediate section (not shown) of the conductors 116 (between the contact beams 130 and the terminating segments 156) to retain the relative positioning and orientations of the conductors 116 within the electrical connector 104. The dielectric carrier 140 is formed of a dielectric material, such as a plastic or one or more other polymers. Optionally, the dielectric carrier 140 may be overmolded around the conductors 116. The dielectric carrier 140 is held in place within the housing 114 (shown in FIG. 1).

Optionally, the rear wall 154 of the dielectric carrier 140 engages an organizer 138. The organizer 138 is configured to engage the terminating segments 156 of the conductors 116 to guide the terminating ends 132 into proper alignment with the corresponding contact elements of the circuit board 102 (shown in FIG. 1). The organizer 138 may be formed of a dielectric material, such as one or more plastics or other polymers.

In an embodiment, at least some of the conductors 116 of the electrical connector 104 are used to convey high speed data signals and some other conductors 116 are used as ground conductors to provide electrical shielding for the high speed signals and ground paths through the connector 104 between the circuit board 102 (shown in FIG. 1) and the mating connector. Some of the conductors 116 may be used to provide low speed data signals, power, or the like, instead of high speed data signals. For example, designated signal conductors may be utilized as differential signal conductors for transmitting high speed differential signals and/or as single-ended signal conductors for transmitting low speed data signals or power. In an exemplary embodiment, at least some of the conductors 116 are configurable in a ground state or a signal state, such that the conductors 116 may be utilized as a ground conductor or as a signal conductor, depending on a desired signal-ground electrical scheme of the array 134 of conductors 116. For example, it may be necessary to utilize five conductors 116 along one array 134 as single-ended conductors for transmitting low speed data signals in one signal-ground electrical scheme, while in another scheme no single-ended conductors are necessary. The electrical connector 104 allows for configuring an array 134 of conductors 116 in various different signal-ground electrical schemes while reducing the amount of unused conductors as compared to known electrical connector systems, allowing for increased contact density and a reduced footprint on the circuit board 102.

For example, an array 134 of conductors 116 includes configurable conductors 158 and signal conductors 160. The signal conductors 160 are not electrically commoned to any other conductors 116 in the array 134. The configurable conductors 158, on the other hand, are each selectively configurable between a ground state and a signal state. The configurable conductors 158 in the ground state define ground conductors that are electrically commoned to one another (for example, to another configurable conductor 158 configured in the ground state) within the electrical connector 104. The configurable conductors 158 in the signal state define signal conductors, and more specifically single-ended signal conductors. The term "configurable" refers to the ability of a conductor 116 to be selectively utilized as a ground conductor or a signal conductor. Although the signal conductors 160 cannot function as ground conductors, each signal conductor 160 may be selectively utilized as either a differential pair signal conductor that conveys high speed data signals or a single-ended signal conductor that conveys low speed data signals or power.

In an embodiment, the electrical connector 104 includes at least one ground tie bar 142. Each ground tie bar 142 extends across a corresponding array 134 of conductors 116. One ground tie bar 142 that extends across the first array 134A is shown in FIG. 2. Although not shown, a second ground tie bar may optionally extend across the second array 134B of conductors 116. The ground tie bar 142 is configured to engage and electrically connect to the configurable conductors 158 to electrically common the configurable conductors 158. For example, the ground tie bar 142 includes a stem 162 and plural ground fingers 164 that are joined to and extend from the stem 162. The ground tie bar 142 may be mounted to the electrical connector 104 such that the stem 162 extends parallel to the lateral axis 192. In the illustrated embodiment, the ground tie bar 142 is mounted directly to a top outer surface 166 of the dielectric carrier 140 such that the ground tie bar 142 is indirectly held by the housing 114 (shown in FIG. 1). In an alternative embodiment, the ground tie bar 142 may be mounted directly to the housing 114 instead of to the dielectric carrier 140.

The stem 162 extends a length between a left end 176 and a right end 178. The plural ground fingers 164 are spaced apart along the length of the stem 162. Each ground finger 164 aligns with one of the configurable conductors 158. The ground fingers 164 are configured to engage and electrically connect to the corresponding configurable conductors 158 that the ground fingers 164 align with. The stem 162 provides a chassis that electrically connects the plural ground fingers 164 together, thereby electrically commoning the configurable conductors 158 engaged by the ground fingers 164. In an embodiment, the configurable conductors 158 that are engaged by the ground fingers 164 are configured in the ground state since these conductors 116 are electrically commoned via the ground tie bar 142.

In the illustrated embodiment, the ground fingers 164 are spaced apart to align with every third conductor 116 in the array 134. Thus, every third conductor 116 in the row 144 is a configurable conductor 158. For example, the configurable conductors 158 are the conductors 116 in the array 134 that align with the ground fingers 164 of the ground tie bar 142. The signal conductors 160 are not aligned with the ground fingers 164. The signal conductors 160 are arranged in pairs 172 between adjacent configurable conductors 158. Adjacent pairs 172 of signal conductors 160 are separated from one another by a single configurable conductor 158. In an embodiment, two ground fingers 164 of the ground tie bar 142 that respectively align with successive configurable conductors 158 are separated from one another by a ground pitch distance 174. The ground pitch distance 174 is greater than the conductor pitch distance 150. In the illustrated embodiment, the ground pitch distance 174 is three times greater than the conductor pitch distance 150.

In an exemplary embodiment, the ground tie bar 142 is programmable to configure the array 134 of conductors 116 in multiple different signal-ground electrical schemes. The signal-ground electrical schemes refer to the number and arrangement of the signal conductors in the array 134. The signal conductors include the signal conductors 160 and the configurable conductors 158 that are in the signal state. The multiple signal-ground electrical schemes include different numbers and/or arrangements of signal transmitting conductors. For example, two signal-ground electrical schemes may differ from one another in the number of total signal conductors (such as the number of high speed differential signal conductors and/or single-ended signal conductors), although the total number of conductors 116 in the array 134 is equal. Two signal-ground electrical schemes may also differ from one another in the arrangement of the signal conductors along the row 144, even if the two schemes both include the same respective numbers of high speed differential signal conductors and single-ended signal conductors. For example, one scheme may include three single-ended signal conductors in a group at an end of the row 144, while another scheme has three single-ended signal conductors in a group that is disposed more proximate to a center of the row 144. The different configurations allow the electrical connector 104 to be customizable and adaptable to different electrical components and devices. Thus, the programmability of the array 134 of the conductors 116 avoids the need for multiple different connectors that each has a different fixed signal-ground electrical scheme. For example, if it is desirable to add a third single-ended signal conductor to an existing pair of single-ended signal conductors, the ground tie bar 142 may be programmed (or reprogrammed) to configure one of the configurable conductors 158 (from the ground state) to the signal state to function as a single-ended signal conductor without requiring a different connector.

In an embodiment, the ground tie bar 142 is programmed by selectively removing one or more of the ground fingers 164 from the ground tie bar 142 to decrease a number of ground fingers 164 of the tie bar 142. When a respective ground finger 164 is removed, the ground finger 164 is no longer present or joined to the ground tie bar 142. Removing a respective ground finger 164 configures an associated configurable conductor 158 that aligns with (or formerly aligned with) the respective ground finger 164 in the signal state (assuming that no other ground fingers 164 still engage the corresponding configurable conductor 158). A configurable conductor 158 is configured in the signal state in response to being electrically isolated from the ground tie bar 142, which occurs when the configurable conductor 158 is not engaged by any ground fingers 164 still joined to the ground tie bar 142. Conversely, when a configurable conductor 158 is engaged by at least one ground finger 164 of the ground tie bar 142, the configurable conductor 158 is configured in the ground state and is electrically commoned to at least one other configurable conductor 158 in the ground state. In an alternative embodiment, instead of mechanically removing a respective ground finger 164 to program the ground tie bar 142, the ground finger 164 may be bent out of plane or otherwise electrically isolated from the corresponding configurable conductor 158 without disconnecting the ground finger 164 entirely from the ground tie bar 142. For example, the respective ground finger 164 may be bent away from the configurable conductor 158 such that the ground finger 164 does not engage and electrically connect to the configurable conductor 158.

In the embodiment shown in FIG. 2, the ground tie bar 142 is in an intact formation and the electrical connector 104 has a first signal-ground electrical scheme. In the intact formation, the ground tie bar 142 is whole and includes all ground fingers 164, such that all ground fingers 164 are present and no ground fingers 164 are removed. For example, the ground tie bar 142 is formed in the intact formation. The ground fingers 164 engage and electrically connect to each of the configurable conductors 158, configuring all of the configurable conductors 158 in the ground state. The configurable conductors 158 are electrically commoned and function as ground conductors that provide electrical shielding between adjacent pairs 172 of signal conductors 160. Since the configurable conductors 158 are all ground conductors when the ground tie bar has an intact formation, the array 134A defines a ground-signal-signal-ground-signal-signal-ground pattern. The pairs 172 of signal conductors 160 may be utilized to transmit high speed differential signals. As described in more detail with reference to FIGS. 5 and 6, the ground tie bar 142 may be programmed by removing at least one of the ground fingers 164 from the ground tie bar 142 (or otherwise electrically isolating the ground tie bar 142 from at least one of the configurable conductors 158).

Figure 3:
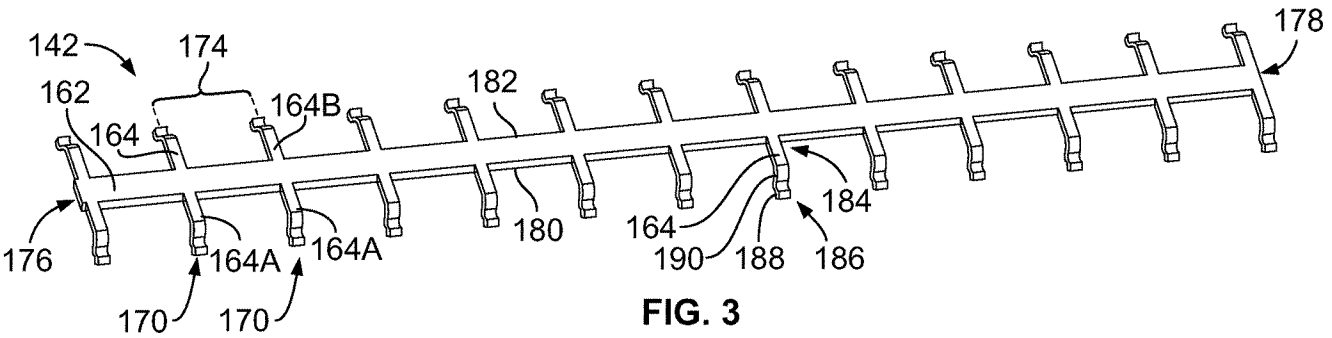
FIG. 3 is a perspective view of a ground tie bar in an intact formation.

FIG. 3 is a perspective view of the ground tie bar 142 in the intact formation shown in FIG. 2. The stem 162 extends the length of the ground tie bar 142 between the left end 176 and the right end 178. In the intact formation, the ground fingers 164 are evenly distributed along the length of the ground tie bar 142 between the ends 176, 178. For example, the ground fingers 164 are evenly spaced apart from adjacent ground fingers 164 by the ground pitch distance 174. The ground tie bar 142 includes outer ground fingers 164 located at the ends 176, 178 of the stem 162 and interior ground fingers 164 disposed between the ends 176, 178. The interior ground fingers 164 are disposed between two other ground fingers 164 such that the interior ground fingers 164 each have two adjacent ground fingers 164, while the outer ground fingers 164 only have one adjacent ground finger 164. As described in more detail below with reference to FIG. 5, when the ground tie bar 142 is in a fractured formation, the ground fingers 164 are not evenly distributed along the length of the ground tie bar 142 between the ends 176, 178.

In the illustrated embodiment, the ground tie bar 142 has a comb structure. For example, the stem 162 is planar and defines a first edge side 180 and an opposite second edge side 182. The edge sides 180, 182 extend the length of the stem 162 between the ends 176, 178. In the illustrated embodiment, the ground fingers 164 extend from both of the edge sides 180, 182. For example, front ground fingers 164A extend from the first edge side 180, and rear ground fingers 164B extend from the second edge side 182. The front ground fingers 164A may extend parallel to one another, and the rear ground fingers 164B may also extend parallel to one another. Optionally, the front ground fingers 164A and/or the rear ground fingers 164B may extend perpendicular to the stem 162.

In the illustrated embodiment, the front ground fingers 164A each align with a respective one of the rear ground fingers 164B to form a set 170 of two ground fingers 164 configured to engage the same configurable conductor 158. The front and rear ground fingers 164A, 164B in the same set 170 extend coaxial to one another in opposite directions from the stem 162. The front and rear ground fingers 164A, 164B are configured to engage the same configurable conductor 158 (shown in FIG. 2) at different locations along the length of the conductor 158, which provides multiple grounding points. The multiple grounding points along the conductor length may reduce resonance noise (for example, resonant frequency spikes) that is conveyed along the configurable conductor 158. In an alternative embodiment, only one ground finger 164 is configured to engage each of the configurable conductors 158. For example, the ground tie bar 142 may include only the front ground fingers 164A shown in FIG. 3, only the rear ground fingers 164B, or the front and rear ground fingers 164A, 164B may be staggered along the length of the stem 162 such that each configurable conductor 158 aligns with either a corresponding front ground finger 164A or a corresponding rear ground finger 164B, but not both.

The ground fingers 164 of the ground tie bar 142 are cantilevered to extend between a fixed end 184 at the stem 162 and an opposite free end 186 that is spaced apart from the stem 162. The cantilevered ground fingers 164 each have a contact interface 188 at or proximate to the free end 186. The contact interface 188 is configured to engage the corresponding configurable conductor 158 (shown in FIG. 2) to electrically connect the configurable conductor 158 to the ground tie bar 142. In an embodiment, the ground fingers 164 are curved or bent out of the plane of the stem 162. For example, the contact interface 188 of each ground finger 164 is offset and disposed along a different plane relative to the fixed end 184 of the respective ground finger 164 at the stem 162. In the illustrated embodiment, the ground fingers 164 include an S-curve 190 between the fixed end 184 and the contact interface 188. The ground fingers 164 are offset such that the contact interfaces 188 engage the corresponding configurable conductors 158 while the stem 162 is spaced apart from and does not engage the conductors 158.

The ground tie bar 142 is formed of an electrically conductive material, such as metal or a metal particle-loaded dielectric. For example, the ground tie bar 142 may be formed by stamping and forming a panel of metal. The ground fingers 164 in an embodiment are formed integral to the stem 162.

FIG. 4 is a close-up perspective view of a portion of the ground tie bar 142 according to an embodiment. As described above, the ground tie bar 142 may be programmed by removing one or more ground fingers 164 from the ground tie bar 142. The ground fingers 164 may be removed by shearing, bending (until break), laser cutting, friction cutting using an abrasive disk, torch cutting, plasma cutting, or the like. In an embodiment, the ground fingers 164 each define a break zone 194 proximate to or at the respective fixed end 184. The break zone 194 is configured to facilitate the removal of the respective ground finger 164 from the ground tie bar 142. The break zone 194 in the illustrated embodiment is a portion of the ground finger 164 with a reduced lateral width (W) and a reduced vertical thickness (T) relative to other portions of the ground finger 164. Thus, by bending or cutting the ground finger 164 at the break zone 194, the ground finger 164 is configured to break off from the ground tie bar 142. The reduced width and/or thickness may have the shape of beveled edges, grooves, indentations, or the like. In an alternative embodiment, the break zone 194 may be characterized by only one of a reduced lateral width or a reduced vertical thickness instead of both, and/or the break zone 194 may include at least one perforation that extends into or fully through the ground finger 164. In another alternative embodiment, the ground fingers 164 do not include a defined break zone 194.

FIG. 5 is a perspective view of the ground tie bar 142 programmed in a fractured formation according to an embodiment. In the fractured formation, at least one of the ground fingers 164 is removed from the ground tie bar 142, such that at least one of the configurable conductors 158 (shown in FIG. 2) is configured in the signal state. In the illustrated embodiment, one of the sets 170 of interior ground fingers 164 and one of the two sets 170 of outer ground fingers 164 have been removed from the ground tie bar 142. For example, in each location, both the front ground finger 164A and the rear ground finger 164B are removed in order to electrically isolate the corresponding configurable conductor 158 (shown in FIG. 2) that aligns with the front and rear ground fingers 164A, 164B.

In response to a ground finger 164 being removed, a remnant 196 of the ground finger 164 is disposed on the stem 162. The remnant 196 is indicative of the ground finger 164 being joined at one time to the ground tie bar 142. The remnant 196 aligns with the configurable conductor 158 (shown in FIG. 2) that is associated with ground finger 164 that has been removed. The size, shape, and contour of the remnant 196 depend on the location of the break point and the method of removing the ground finger 164. For example, if a laser beam is used to remove the ground finger 164, the remnant 196 may include structural markings and characteristics indicative of the laser cutting (or singulation) process. The remnant 196 may extend at least partially outward from the stem 162, such as outward from the respective first or second edge side 180, 182 from which the ground finger 164 extended prior to being removed. Although not shown in FIG. 5, the remnant 196 may alternatively, or in addition, extend at least partially inward into the stem 162 such as a slight cut-out portion of the stem 162.

In the fractured formation, the remaining ground fingers 164 are not evenly distributed along the length of the ground tie bar 142 due to at least one of the ground fingers 164 being removed. When at least one ground finger 164 (or one set 170 of ground fingers 164) is removed from the ground tie bar 142, a discontinuity may be defined along the length of the ground tie bar 142 at the one or more remnants 196. The discontinuity represents a spacing between two remaining adjacent ground fingers 164 (or one remaining ground finger 164 and one of the ends 176, 178 of the stem 162) that is different than the spacing between two other remaining adjacent ground fingers 164. A first discontinuity 198 is defined between the two ground fingers 164 on either side of the remnant 196 of the interior ground finger 164 that has been removed. The two ground fingers 164 are separated from one another by a pitch distance that is two times the ground pitch distance 174. A second discontinuity 200 is defined between the ground finger 164 that is adjacent to the remnant 196 of the outer ground finger 164 that has been removed and the right end 178 of the stem 162. The distance between the remaining ground finger 164 and the right end 178 is greater than the spacing between the remaining ground finger 164 and the adjacent ground finger 164 on the other side of that ground finger 164.

It should be recognized that any of the ground fingers 164 of the ground tie bar 142 may be selectively removed to program the ground tie bar 142, and not only the two sets 170 of ground fingers 164 that are removed in FIG. 5. For example, in other embodiments, only one set of ground fingers 164 may be removed or, alternatively, three or more sets may be removed to program the ground tie bar 142 in the fractured formation. In addition, two or more adjacent sets 170 of ground fingers 164 may be removed, such as to define a longer discontinuity than the discontinuities 198, 200 shown in FIG. 5.

FIG. 6 is a front perspective view of the electrical connector 104 configured in a second signal-ground electrical scheme according to an embodiment, as compared to the configuration of the connector 104 shown in FIG. 2. The electrical connector 104 is shown in FIG. 6 with the housing 114 (shown in FIG. 1) removed to better illustrate the interior components. In response to removing the set 170 of interior ground fingers 164, the configurable conductor 158A that aligns with the remnants 196 of the set 170 is electrically isolated from the ground tie bar 142. Thus, the conductor 158A is configured in the signal state since the conductor 158A is not electrically commoned to other configurable conductors 158 via the ground tie bar 142. The configurable conductor 158A is surrounded by two pairs 172 of signal conductors 160. Since the configurable conductor 158A in the signal state defines a signal conductor, the two pairs 172 of signal conductors 160 and the configurable conductor 158A define a group 202 of five signal conductors disposed side-by-side along the row 144 of conductors 116. The group 202 may be utilized as five single-ended conductors for transmitting low speed data signals, power, and/or the like. No conductors 116 are unused in order to achieve the group 202 of five single-ended conductors, since the two configurable conductors 158 that border the group 202 are configured in the ground state for providing shielding to the signal conductors 160 on the outer sides of the two configurable conductors 158 (which may function as pairs of differential signal conductors).

Furthermore, in response to removing the set 170 of outer ground fingers 164, the configurable conductor 158B at the end of the array 134A that aligns with the remnants 196 of the set 170 is also electrically isolated from the ground tie bar 142, and so is configured in the signal state. The configurable conductor 158B and the pair 172 of signal conductors 160 adjacent to the configurable conductor 158B define a group 204 of three signal conductors disposed side-by-side along the row 144. Like the group 202 of five signal conductors, the group 204 of three signal conductors may be utilized as three single-ended conductors for transmitting low speed data signals, power, and/or the like.

In known electrical connectors, ground conductors are not able to be reconfigured as single-ended signal conductors, so achieving five single-ended conductors would require three pairs of designated signal conductors. The two ground conductors between the three pairs of signal conductors and the sixth signal conductor (the one signal conductor not used as a single-ended conductor) would all be unused, which undesirably reduces the contact density of the electrical connector and wastes valuable space. In addition, to achieve three single-ended conductors, two pairs of signal conductors are required and still two conductors would be unused (the ground conductor between the two pairs and the fourth signal conductor).

In the illustrated embodiment, the ground tie bar 142 is mounted to the top outer surface 166 of the dielectric carrier 140. The top outer surface 166 defines a matrix cavity 210 that receives the ground tie bar 142 therein. The matrix cavity 210 is open at the top outer surface 166 such that the ground tie bar 142 is mounted to the dielectric carrier 140 by lowering the ground tie bar 142 into the matrix cavity 210 from above. The matrix cavity 210 defines a lateral channel 212 and longitudinal slots 214 that branch off from the channel 212. The stem 162 of the ground tie bar 142 is received in the channel 212, and the ground fingers 164 are each received in a corresponding one of the slots 214. The channel 212 and/or the slots 214 may include interference features, such as protrusions 218 that are configured to engage the ground tie bar 142 to retain the ground tie bar 142 within the matrix cavity 210. In an embodiment, the slots 214 define openings 216 that extend between the slots 214 and the configurable conductors 158 held within the dielectric carrier 140. For example, the contact interfaces 188 of the ground fingers 164 are configured to extend through the openings 216 to engage the corresponding configurable conductors 158. The S-curve portion 190 of the ground fingers 164 spans the depth of the opening 216 between the slot 214 and the corresponding conductor 158.

Although only one ground tie bar 142 is shown in FIG. 6, a second ground tie bar configured to engage the conductors 116 in the second array 134B may be mounted to a bottom outer surface 220 of the dielectric carrier 140 or directly to the housing 114 (shown in FIG. 1).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector configured to mate to a mating connector, the electrical connector comprising:

an array of conductors held at least partially within a housing, the conductors in the array arranged side-by-side along a row, the array of conductors including signal conductors and configurable conductors, the configurable conductors each being selectively configurable between a ground state and a signal state to define a ground conductor or a signal conductor, respectively; and a ground tie bar extending across the array of conductors, the ground tie bar including a stem, wherein the stem has first and second edge sides; plural ground fingers extending from both the first and second edge sides along the length of the stem, the ground fingers cantilevered to extend between a fixed end at the stem and an opposite free end; the ground tie bar being programmable to selectively remove one or more of the ground fingers from the ground tie bar to decrease a number of ground fingers of the ground tie bar, a respective configurable conductor being in the ground state when one of the ground fingers extending from the first edge side and one the ground fingers extending from the second edge side engage the respective configurable conductor in two different locations along the respective configurable conductor, the respective configurable conductor being in the signal state when both of the ground fingers of the set are removed from the ground tie bar, and thus not present, to increase a number of the signal conductors in the array of conductors to correspond with a desired signal-ground electrical scheme;

wherein the ground fingers each define a break zone at least one of at or proximate to the fixed end, the ground finger at the break zone having at least one of a reduced width relative to other portions of the ground finger, a reduced thickness relative to other portions of the ground finger, or a perforation to facilitate the removal of the ground finger from the ground tie bar.

2. The electrical connector of claim 1, wherein, in response to a respective ground finger being removed from the ground tie bar, a remnant of the ground finger is disposed on the stem, the remnant being indicative of the ground finger being joined at one time to the ground tie bar, the remnant being aligned with the associated configurable conductor.

3. The electrical connector of claim 2, wherein two ground fingers of the ground tie bar that respectively align with successive configurable conductors are separated from one another by a ground pitch distance, and wherein two ground fingers disposed on either side of the remnant of a respective ground finger that is removed from the ground tie bar are separated by a distance that is at least two times greater than the ground pitch distance.

4. The electrical connector of claim 1, wherein adjacent conductors in the array are separated by a conductor pitch distance, and wherein two ground fingers of the ground tie bar that respectively align with successive configurable conductors of the conductors are separated by a ground pitch distance that is greater than the conductor pitch distance.

5. The electrical connector of claim 4, wherein the ground pitch distance is three times greater than the conductor pitch distance.

6. The electrical connector of claim 1, wherein the signal conductors are arranged in pairs, adjacent pairs of signal conductors being separated by one of the configurable conductors.

7. The electrical connector of claim 6, wherein, when a respective interior ground finger disposed between two other ground fingers along the ground tie bar is removed, the corresponding configurable conductor associated with the interior ground finger and the two pairs of signal conductors on either side of the corresponding configurable conductor define a group of five signal conductors disposed side-by-side along the row of conductors.

8. The electrical connector of claim 6, wherein, when an outer ground finger that is disposed at an end of the stem of the ground tie bar is removed, the corresponding configurable conductor associated with the outer ground finger and the pair of signal conductors adjacent to the corresponding configurable conductor define a group of three signal conductors disposed side-by-side along the row of conductors.

9. The electrical connector of claim 1, further comprising a dielectric carrier that is held within the housing of the electrical connector, the conductors of the array extending through the dielectric carrier, an outer surface of the dielectric carrier defining a matrix cavity that receives the ground tie bar therein to mount the ground tie bar to the dielectric carrier.

10. The electrical connector of claim 1, wherein the ground tie bar has a comb structure, the ground fingers extending from the stem parallel to one another.

11. The electrical connector of claim 1, wherein the signal conductors are each configured to selectively define one of a differential signal conductor that transmits high speed differential signals or a single-ended signal conductor that transmits low speed data signals.

12. An electrical connector configured to mate to a mating connector, the electrical connector comprising:

an array of conductors held at least partially within a housing, the conductors in the array arranged side-by-side along a row, the array of conductors including signal conductors and configurable conductors, the configurable conductors each being selectively configurable between a ground state and a signal state to define a ground conductor or a signal conductor, respectively;

a dielectric carrier that is held within the housing, the conductors of the array extending through the dielectric carrier, an outer surface of the dielectric carrier defining a matrix cavity; and a ground tie bar received in the matrix cavity to mount the ground tie bar to the dielectric carrier, the ground tie bar extending across the array of conductors, the ground tie bar including a stem and plural ground fingers joined to and extending from the stem, the ground fingers, when present, aligning with associated configurable conductors to engage and electrically connect to the configurable conductors, the ground tie bar being programmable from an intact formation to a fractured formation by selectively removing one or more of the ground fingers from the ground tie bar, such that the one or more ground fingers are not present, to decrease a number of ground fingers of the ground tie bar, wherein, in the intact formation of the ground tie bar, all of the configurable conductors are engaged by the associated ground fingers and are in the ground state due to the engagement with the ground fingers of the ground tie bar, and wherein, in the fractured formation of the ground tie bar, a respective configurable conductor that is associated with a ground finger removed from the ground tie bar is in the signal state, increasing a number of the signal conductors in the array of conductors to correspond with a desired signal-ground electrical scheme.

13. The electrical connector of claim 12, wherein, in the intact formation of the ground tie bar, the ground fingers are evenly distributed along the length of the ground tie bar between ends of the stem, and, in the fractured formation of the ground tie bar, the ground fingers are not evenly distributed along the length of the ground tie bar due to at least one of the ground fingers being removed from the ground tie bar, and thus not present.

14. The electrical connector of claim 13, wherein, in the intact formation of the ground tie bar, adjacent ground fingers are spaced apart by a ground pitch distance along the length of the ground tie bar, and, in the fractured formation of the ground tie bar, a discontinuity is defined along the length of the ground tie bar between two ground fingers on either side of a remnant of a respective ground finger that is removed from the ground tie bar, the discontinuity having a length greater than the ground pitch distance.

15. The electrical connector of claim 12, wherein the signal conductors are arranged in pairs, adjacent pairs of signal conductors being separated by one of the configurable conductors, and wherein, in the intact formation of the ground tie bar, the signal conductors and the configurable conductors define a ground-signal-signal-ground-signal-signal-ground pattern.

16. The electrical connector of claim 15, wherein, in the fractured formation of the ground tie bar, when a respective interior ground finger disposed between two other ground fingers is removed, the corresponding configurable conductor associated with the interior ground finger and the two pairs of signal conductors on either side of the corresponding configurable conductor define a group of five signal conductors disposed side-by-side along the row of conductors.

17. The electrical connector of claim 15, wherein, in the fractured formation of the ground tie bar, when a respective outer ground finger disposed at one of the ends of the stem is removed, the corresponding configurable conductor associated with the outer ground finger and the pair of signal conductors adjacent to the corresponding configurable conductor define a group of three signal conductors disposed side-by-side along the row of conductors.

18. The electrical connector of claim 12, wherein the ground fingers are each cantilevered to extend between a fixed end at the stem and an opposite free end, the ground fingers defining a break zone at least one of at or proximate to the fixed end, the ground finger at the break zone having at least one of a reduced lateral width relative to other portions of the ground finger, a reduced vertical thickness relative to other portions of the ground finger, or a perforation.

19. The electrical connector of claim 12, wherein the matrix cavity in the outer surface of the dielectric carrier includes a lateral channel and longitudinal slots branching from the lateral channel, the stem held in the lateral channel, the ground fingers held in corresponding longitudinal slots.

* * * * *